US007712699B2

(12) United States Patent
Granger

(10) Patent No.: US 7,712,699 B2
(45) Date of Patent: May 11, 2010

(54) ANTI-KINK CONTROL DEVICE FOR AN AUTOMATIC WIPING MATERIAL DISPENSER UNIT

(76) Inventor: Maurice Granger, 17 Rue Marcel Pagnol, 42270, Saint Priest en Jarez (FR)

( * ) Notice: Subject to any disclaimer, the term of this patent is extended or adjusted under 35 U.S.C. 154(b) by 552 days.

(21) Appl. No.: 11/569,628

(22) PCT Filed: May 10, 2005

(86) PCT No.: PCT/FR2005/050309

§ 371 (c)(1),
(2), (4) Date: Apr. 6, 2007

(87) PCT Pub. No.: WO2005/117675

PCT Pub. Date: Dec. 15, 2005

(65) Prior Publication Data

US 2007/0278334 A1 Dec. 6, 2007

(30) Foreign Application Priority Data

May 28, 2004 (FR) ..... 04 51065
Aug. 11, 2004 (FR) ..... 04 51835

(51) Int. Cl.
*A47K 10/24* (2006.01)
*A47K 10/36* (2006.01)

(52) U.S. Cl. ..... 242/564.1; 242/579; 83/335

(58) Field of Classification Search ..... 242/563, 242/264.1–264.4, 579, 580, 595.1, 615.2; 83/334, 335.649, 949
See application file for complete search history.

(56) References Cited

U.S. PATENT DOCUMENTS 2,833,489 A * 5/1958 Hall ..... 242/564.4
3,647,159 A 3/1972 Bump
3,896,691 A * 7/1975 Granger et al. ..... 83/335
5,758,840 A * 6/1998 Murakami ..... 242/415
5,868,343 A * 2/1999 Granger ..... 242/564.4
6,196,102 B1 3/2001 Granger
6,363,824 B1 4/2002 Granger
6,691,597 B2 * 2/2004 Granger ..... 83/335
6,962,101 B2 * 11/2005 Granger ..... 83/337
6,988,437 B2 * 1/2006 Granger ..... 83/335
7,066,070 B2 * 6/2006 Granger et al. ..... 83/649
2004/0129824 A1 * 7/2004 Granger ..... 242/564.4

FOREIGN PATENT DOCUMENTS

FR 2805449 A 8/2001
GB 997553 A 7/1965

* cited by examiner

*Primary Examiner*—Evan H Langdon
(74) *Attorney, Agent, or Firm*—Heslin Rothenberg Farley & Mesiti P.C.

(57) ABSTRACT

Anti-curl control device for an automatic dispenser of wipe materials, of the type incorporating a housing with lid, fixed end plates supporting a drum incorporating a cutting device, a material reel wound on a core having end fittings and a press roller counter-bearing upon the drum. The anti-curl device comprises a roller having a peripheral surface with protruding griping feature. The roller is freely rotatable relative to supporting plates extending from a reel-holder end plate which is flexible relative to a fixed end plate. The roller is angled obliquely relative to the material reel and comes into localized contact along its generatrix with the last turn of the reel to ensure a braking effect. The roller is linked to rotation of the drum and the reel-holder end plate is elasticly deflected to adjust in position as the reel is unwound.

12 Claims, 7 Drawing Sheets

Figure 1:
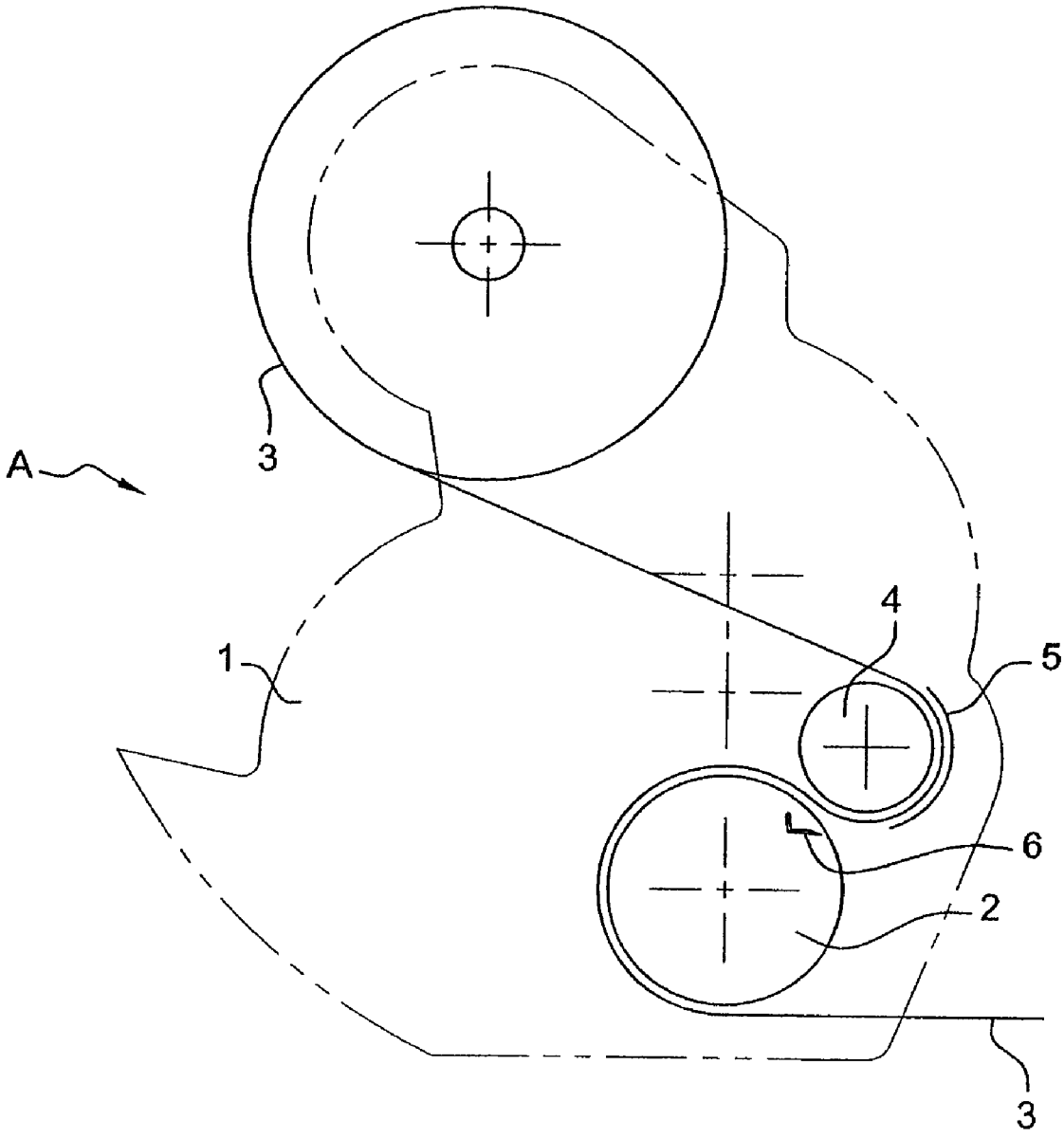

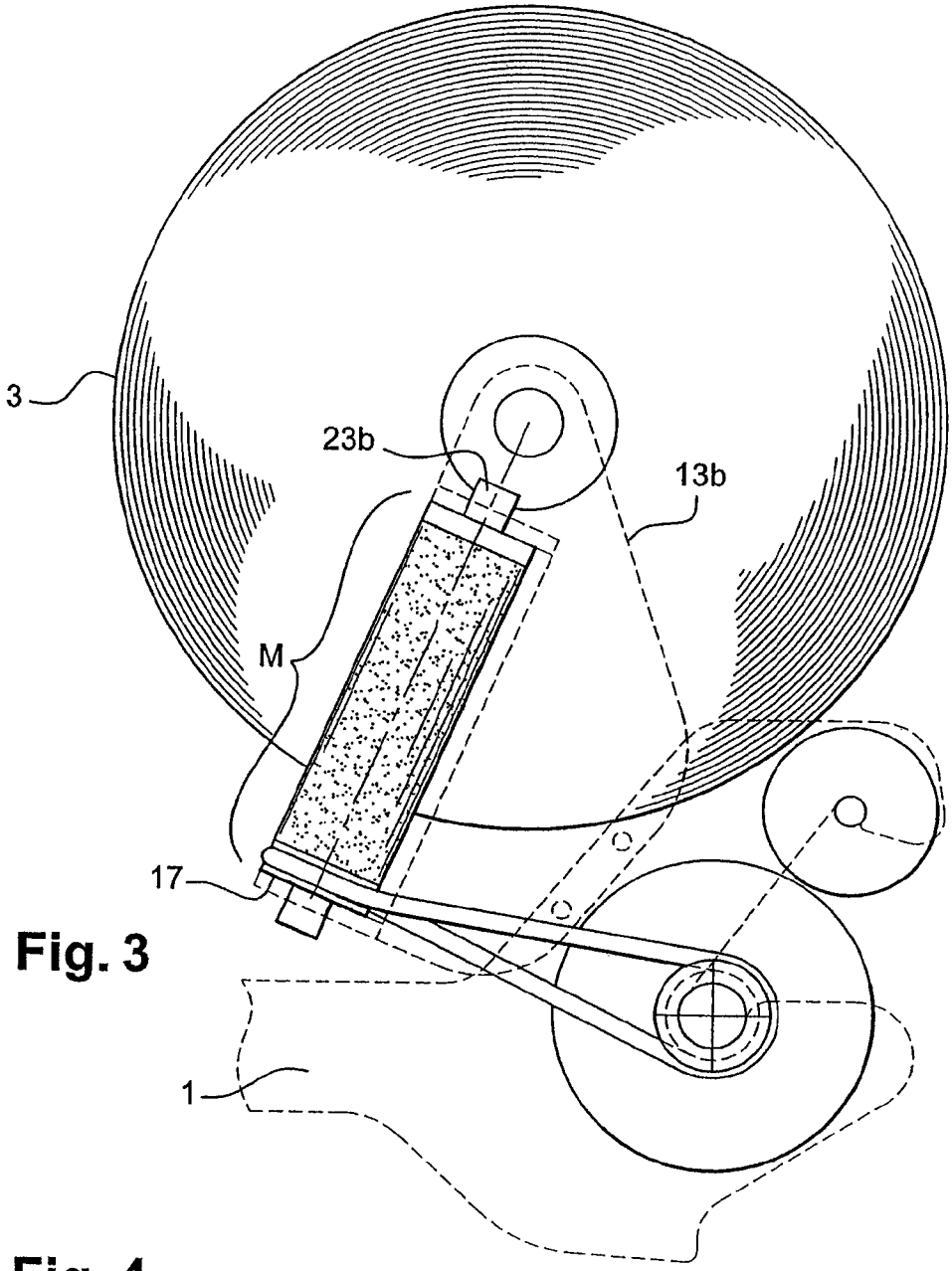
Fig. 3
Fig. 4
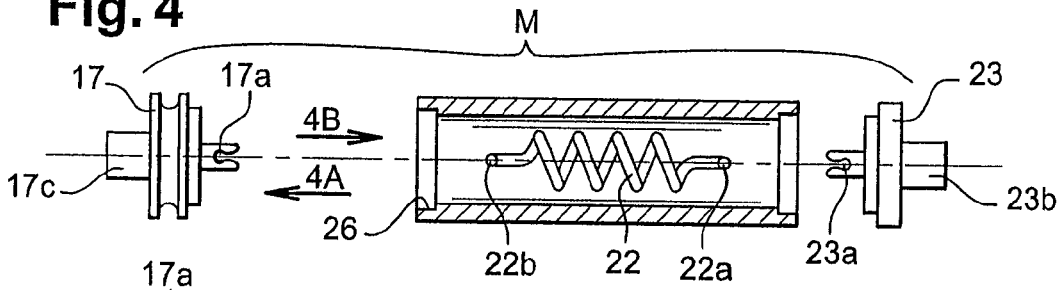
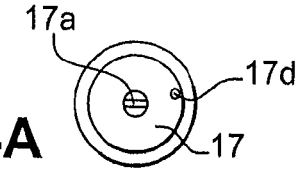
Fig. 4A
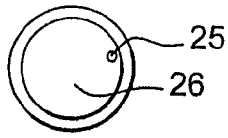
Fig. 4B

ANTI-KINK CONTROL DEVICE FOR AN AUTOMATIC WIPING MATERIAL DISPENSER UNIT

CROSS REFERENCE TO RELATED APPLICATIONS

This is a Section 371 filing of International Application PCT/FR2005/050309, filed on May 10, 2005, and published, in French, as International Publication No. WO 2005/117675 A1 on Dec. 15, 2005, and claims priority of French Application No. 0451065, filed on May 28, 2004 and French Application No. 0451835, filed on Aug. 11, 2004, all of which applications hereby incorporated by reference herein, in their entirety.

BACKGROUND ART

The invention relates to the technical field of dispensers of wipe materials, of the paper, cotton wool, recycled paper type, and this with automatic cutting.

The applicant has specialized for more than thirty or so years in the design of this type of dispenser, which is utilized internationally. These dispensers (A) are of the type, based on a housing with lid, to laterally receive end plates (1), from which there are disposed a drum (2) incorporating a cutting device (6), a material reel (3) wound on a supporting core having end fittings, which take up position on the reel-holder end plate portion. A press roller (4) comes to counter-bear upon the drum between which the pulled material band passes, which follows the path represented diagrammatically in FIG. 1. The material band is tugged by the user as it leaves the dispenser and, depending on the traction force, which is extremely variable, a phenomenon can occur involving the appearance of material curls formed between the press roller and the reel.

In order to eliminate this drawback, the applicant has developed various means and devices having an anti-curl function, these devices acting essentially upon the material reel to make it turn in the direction counter to its usual direction of unwinding in order to effect a rewind operation. Thus, such devices are described in the following French patents of the applicant, FR 0002722, FR 9719536, FR 0312506, FR 0312505.

These devices are very reliable and meet perfectly the requirements, and this for the great majority of paper-type material reels, which are found, in particular, on the European market.

The defined problem resides, however, with certain types of material reels, consisting of recycled paper, which are extremely smooth, so that the material turns slide amongst themselves and the anti-curl devices previously developed by the applicant prove insufficient to prevent curls from forming after a strong tug.

This situation is extremely annoying, since the use of smooth recycled paper wound onto a reel is becoming increasingly widespread and, unfortunately, one can only note the lack of results from previous devices, with an increase in maintenance, numerous dispensers falling "out of service" if the curls of material bands are not automatically eliminated.

The approach of the applicant has therefore been to consider a new design of anti-curl device on the dispenser of the aforesaid type, which addresses the defined problem relative to the material reels of the smooth recycled paper type, but which also, by the same event, remains applicable to the other material reels of the type for which the anti-curl devices designed and developed by the applicant remain valid.

The entire difficulty was therefore to design a new anti-curl device without deploying a complexity of means and components which add to the cost of the dispenser and without sacrificing effectiveness.

In order to address the defined problem, the first direction of research was to improve the existing anti-curl devices to make them more effective with respect to this type of smooth recycled paper. In practice, the envisaged modifications and improvements have proved inadequate and, in any event, not sufficiently reliable to dispense in large runs and on a continuous basis material bands with the aforesaid smooth recycled paper. Performances in the past are inadequate and there can therefore be no question of putting on the market solutions which have been unreliable in the past, which then pose maintenance problems for companies which operate dispensers of this type and which supply reels.

The approach of the applicant has therefore been to fully reconsider the concept of the anti-curl device and, starting from a value analysis, to make certain modifications to the actual design of the dispenser, in particular starting from its loading arm.

This new approach has thus enabled a very simple and effective solution to be found, which addresses the defined problem and, additionally and unexpectedly, simplifies the loading of the material reel in the dispenser.

BRIEF SUMMARY OF THE INVENTION

Thus, according to a first characteristic of the invention, the anti-curl device capable of acting on the material reel of a dispenser with automatic cutting of material bands, of the type incorporating, starting from a housing with lid, fixed end plates from which there are disposed a drum incorporating a cutting device, with material reel wound on a core having end fittings, and a press roller counter-bearing upon the drum, is characterized in that the said anti-curl device is constituted by a roller-forming means having a peripheral surface with protruding gripping means, the said means being freely rotatable relative to supporting planes formed from a reel-holder end plate which is flexible relative to the end plate receiving the drum, the said means being angled obliquely relative to the material reel and coming into localized contact along its generatrix with the last turn of the reel to ensure a braking effect, and in that the said roller-shaped means is linked to the rotation of the drum by a transmission means which couples them together, and in that the reel-holder end plate receiving the end fitting and the said means has an elastic deflection capability in order to adjust in position as the reel is unwound.

These characteristics and others will become clearly apparent from the remainder of the description.

BRIEF DESCRIPTION OF THE DRAWING FIGURES

Figure 2:
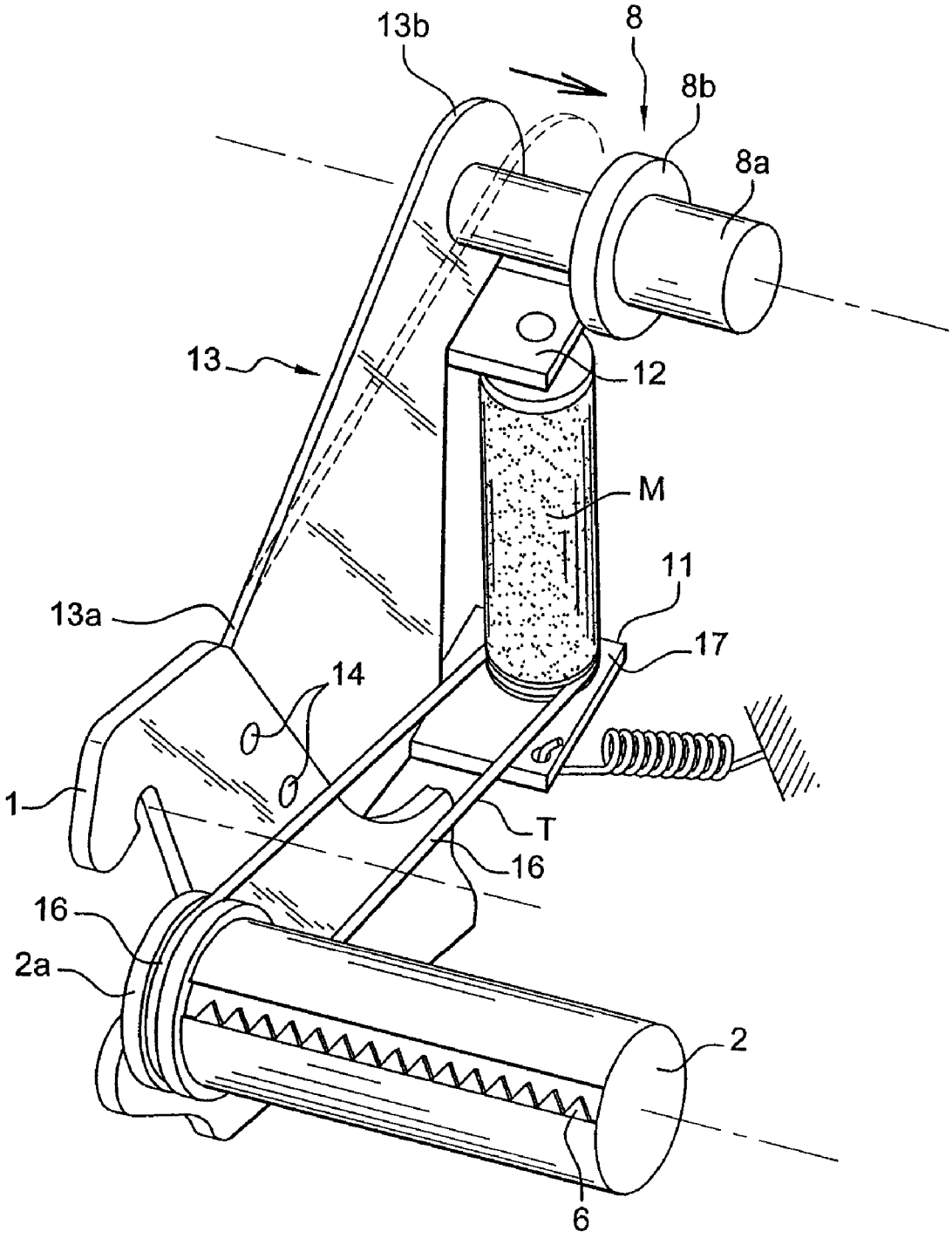
Figure 5:
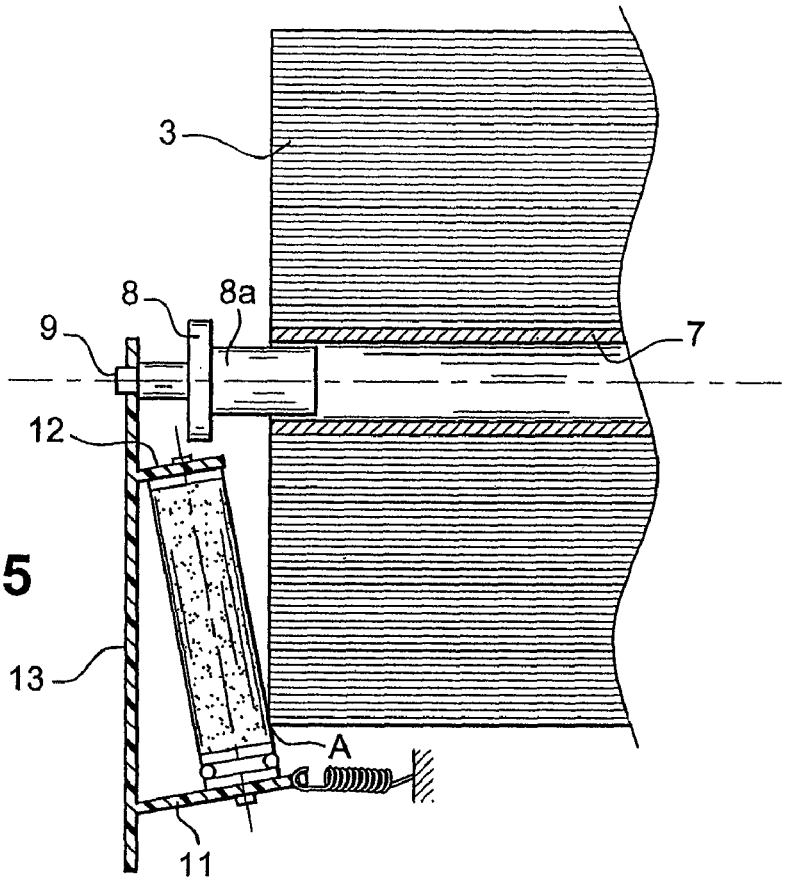
Figure 6:
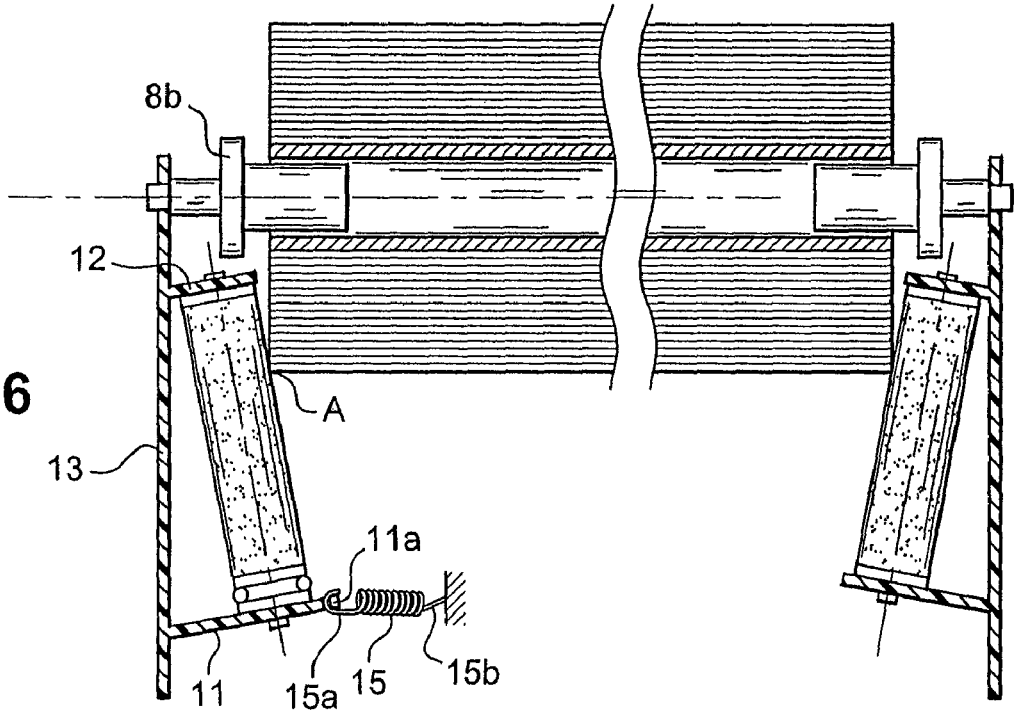
Figure 7:
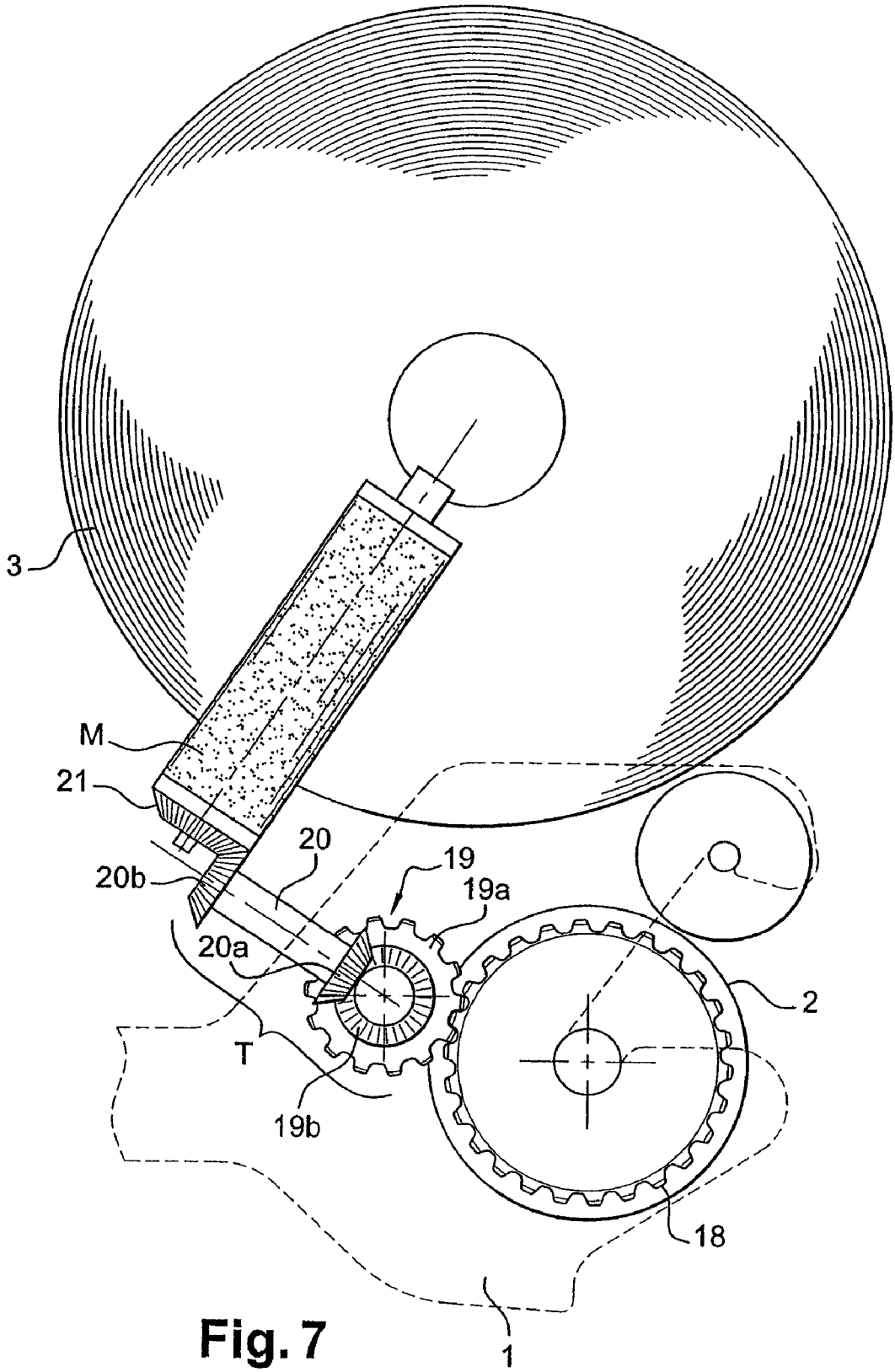
Figure 8:
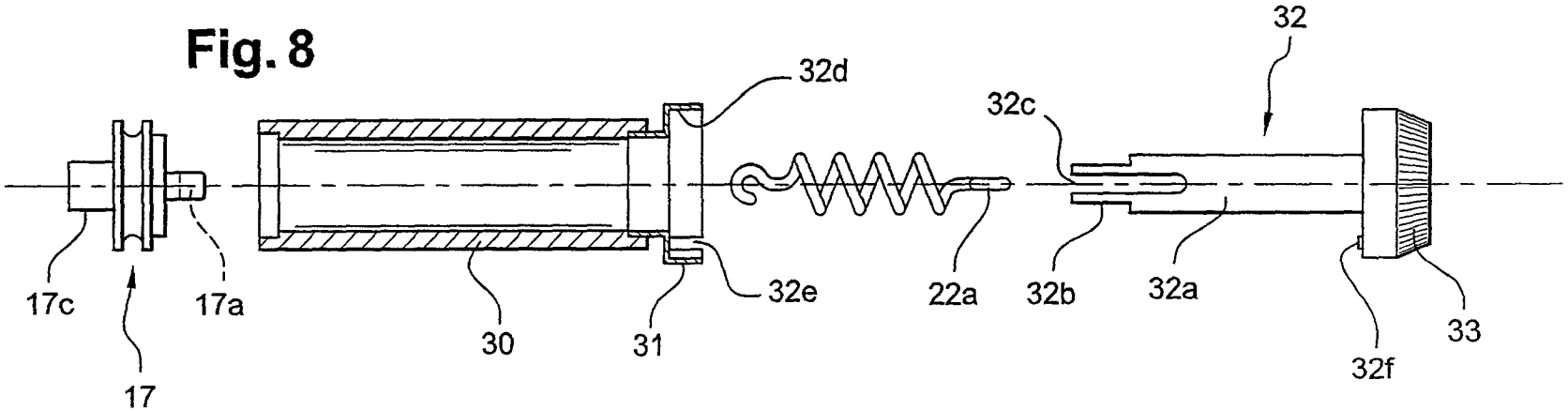
Figure 9A:
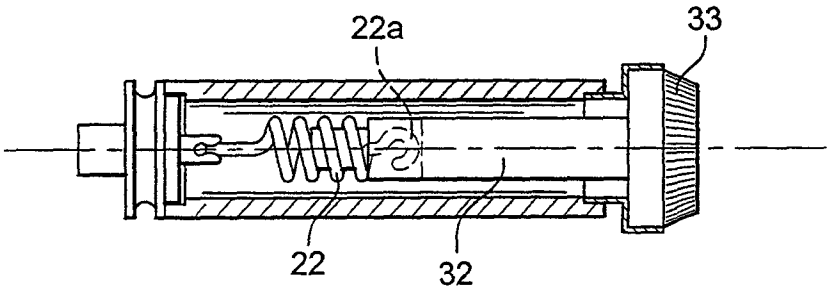
Figure 9B:
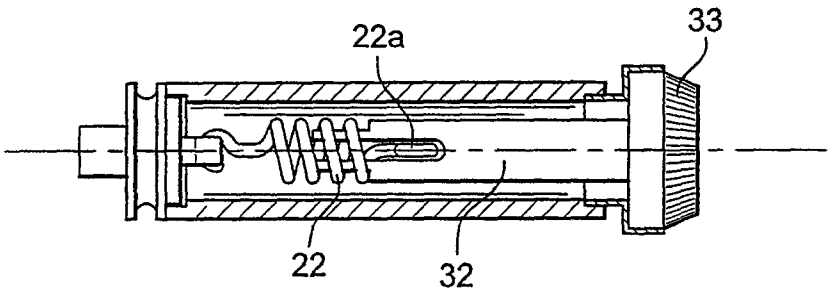
Figure 10:
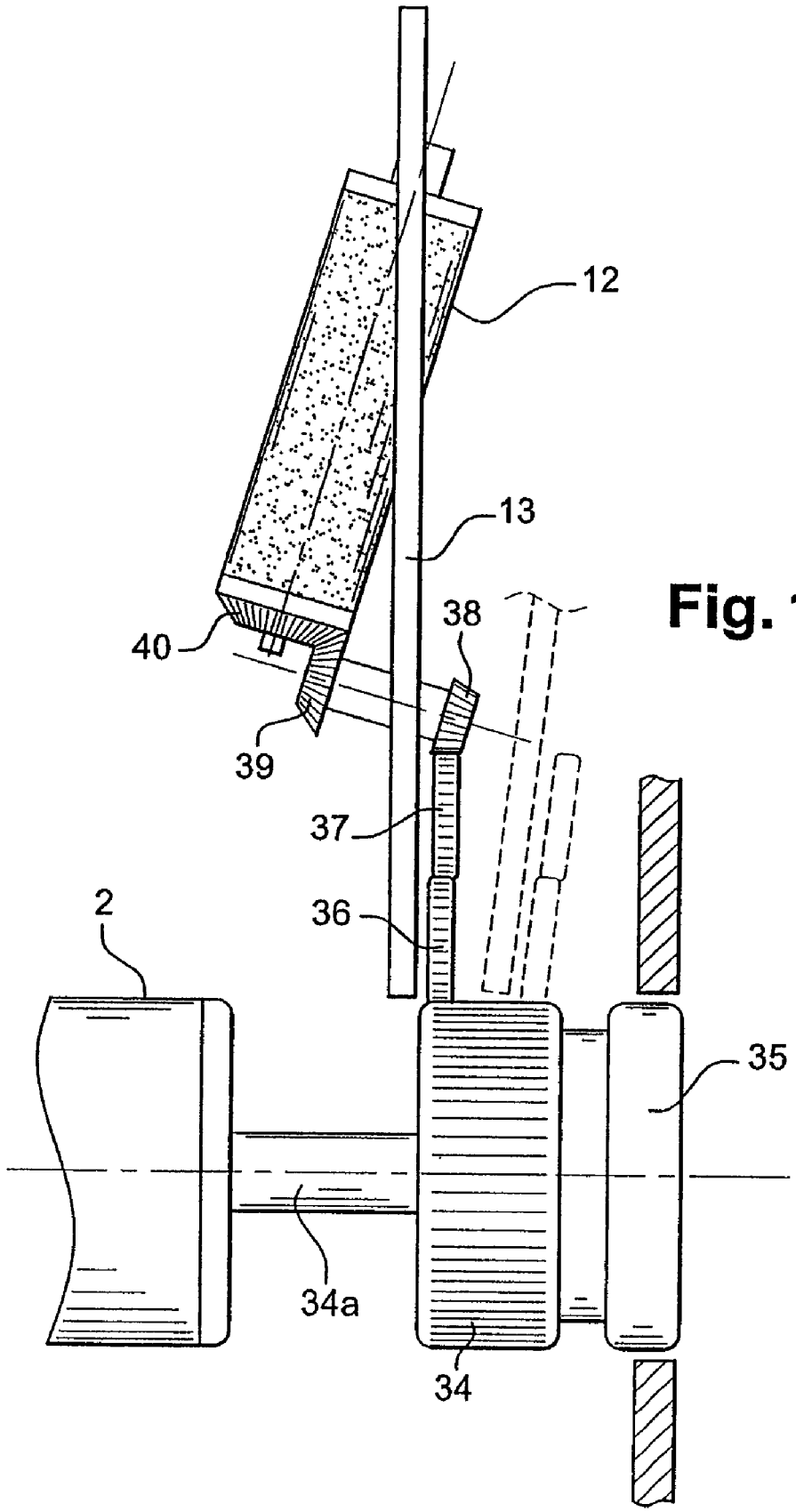

In order to define the subject of the invention, it is illustrated in a non-limiting manner in the figures of the drawings, in which:

FIG. 1 is a diagrammatic view illustrating a dispenser with automatic cutting of wipe material, in its general representation, FIG. 2 is a perspective view of the device according to the invention incorporated in a dispenser of the aforesaid type, and this with a first variant of the means for transmitting motion between the drum receiving the cutting device and the anti-curl device, FIG. 3 is a side view showing the deployment of the device of the invention against the material reel, FIG. 4 is an exploded sectional view prior to mounting of the roller-shaped means cooperating with the material reel, FIGS. 4A and 4B are frontal views of a pulley-forming component and of the other end of the roller, FIG. 5 is a view in partial section illustrating the position of the device relative to the material reel, this being represented at the start of the unwinding, FIG. 6 is a sectional view in two halves illustrating, in the left-hand part, the positioning of the device of the invention in the advanced unwinding stage of the reel and, in the right-hand part, the use of a means complementary to the device, which stabilizes the material reel in position, FIG. 7 is a variant view of the means for transmitting motion to the drum, which is rotationally driven by the tugging of the material band by the user, and the anti-curl device, FIG. 8 is a sectional view prior to mounting of the roller-shaped means cooperating with the material reel in a deployment variant, FIGS. 9A-9B are views, according to FIG. 8, in the representation of the spring means mounted on a supporting sleeve intended to be introduced into the roller, FIG. 9B being represented at 90° relative to FIG. 9A, FIG. 10 is a variant view of the arrangement of the supporting end plate of a roller according to the invention, the end plate being able to have a freedom of flexibility and/or pivoting which is limited according to the construction of the dispenser.

DETAILED DESCRIPTION

In order to make the subject of the invention more concrete, it is described in a non-limiting manner illustrated in the figures of the drawings.

The material reel (3) is wound on a tubular core (7) receiving at each of its ends an end fitting (8) capable of being mounted on the reel-holder end plate. The end fitting has a cylindrical neck (8*a*) penetrating into the core and a collar (8*b*) capable of coming to bear against the transverse face of the reel. The end fitting (8) is thus mounted in a freely rotatable manner on a supporting axle (9), which, for its part, is fixedly connected to the reel holder.

The anti-curl device according to the invention is constituted by a roller-forming means (M) having a peripheral surface with protruding gripping means, the said means being mounted in a freely rotatable manner relative to supporting planes (11-12) formed from the reel-holder end plate (13) and orientated such that the said means (M) is positioned obliquely relative to the material reel (3) and comes into localized contact along its generatrix with the last turn of the reel to ensure a braking effect, the said roller-shaped means (M) being linked to the rotation of the drum by a transmission means (T) which couples them together, the reel-holder end plate (13) receiving the end fitting and the said means (M) having an elastic deflection capability in order to adjust in position as the reel is unwound. It is worth specifying that the longitudinal axis of the means (M) is positioned perpendicular to the axis of the reel and in exact alignment with the reel support.

More particularly, referring to FIG. 2, one of the end plates (1) of the housing of the dispenser, from which is positioned the blade-holder drum (2) of the cutting device and the press roller, fixedly receives the reel-holder end plate (13), allowing the latter a certain flexibility according to the arrow (F), as will be set out below. The connection of the reel-holder end plate (13) by its front portion (13*a*) to the end plate (1) is established with the aid of screwing means (14), for example, or gluing, or other means. The said reel-holder end plate (13) extends rearwards from the housing of the dispenser with a tall portion (13*b*) for receiving the supporting axle (9) of the aforesaid end fitting (8). The said end plate has in its rear portion two parallel supporting planes (11-12), between which is positioned the roller-shaped means (M) of the anti-curl device. The two supporting planes (11-12) are obtained directly by moulding with the end plate (13). The lower supporting plane (11) has a notch (11*a*) for the fastening of one end (15*a*) of a return spring (15), the other end (15*b*) of which is anchored on the portion facing the housing of the dispenser. It will thus be appreciated that the degree of flexibility of the supporting end plate (13) is limited and controlled by the said return means.

As can be seen in FIGS. 5 and 6, the roller-shaped means (M) is angled obliquely so as to have its generatrix longitudinally in partial contact with the material reel and, more particularly, at the location of its outer turn. In the position of FIG. 5, the material reel is in place and the localized contact (A) is realized close to the bottom end of the roller-shaped means (M), the away movement of the end plate (13) being maximal in this position, and this through the extension effect of the elastic return means (15).

In this situation, the end fitting (8) has partially emerged from the supporting core of the reel, a part of its cylindrical portion (8*a*) remaining in position. In the situation of FIG. 6 and in the left-hand representation part, the material reel is largely unwound and the point of contact (A) with the means (M) has shifted along the longitudinal generatrix of the latter. The end plate (13) has thus drawn closer under the slackening and return effect of the elastic means and the end fitting, by being correspondingly thrust in, again finds itself positioned and inserted in the core.

It is now worth describing the deployment of the transmission means (T) between the drum (2) and the oblique roller-shaped means (M).

A first deployment of the transmission means, illustrated in FIGS. 2 and 3, consists in the use of a continuous drive belt (16).

In order to effect this, the drum (2) has an end with an extension forming a groove (2*a*) concentric to the axle of the drum and serving to accommodate and guide the said belt (16).

The roller-shaped means (M) has a bottom end, a component (17) incorporating a pulley-shaped portion capable of receiving the said transmission belt (16), and this in a plane different from its position on the drum. The means (M) has at its ends positioning pins penetrating into the supporting planes (11-12). It will be fully appreciated that the effect of tugging of a material band by the user, which drives the rotation of the drum and the emergence of the cutting blade, simultaneously drives the rotation of the means (M), which thus accompanies the unwinding of the reel always with the point of localized contact (A), which latter shifts along the means (M).

FIG. 7 represents a second variant of a transmission (T) between the drum (2) and the means (M). This constitutes a mechanical deployment based on components in the form of pinions. Various components have thus been diagrammatized, which allow the rotation of the means (M) from the rotation of the drum (2) in order to create the desired effect on the reel.

In this deployment, the drum (2) receives, instead and in place of the aforesaid groove (2*a*) receiving the belt (16), a spur gear wheel (18) mounted axially on the axle of the drum.

On the lateral end plate (1) there is mounted and fixed in a plane perpendicular to the said gear wheel a transmission means (19) having two coaxial pinions (19*a*-19*b*), one with straight toothing (19*a*) mating with the gear wheel (18) and the other with conical toothing (19*b*). The latter is in this case capable of cooperating, in turn, with a linking and connecting shaft (20), mounted with respect to the flexible end plate (13) with the aid of all appropriate supports and having at each of its ends two bevel pinions (20*a*-20*b*), one (20*a*) cooperating with the bevel pinion (19*b*) and the other (20*b*) cooperating with a bevel pinion (21) disposed at the end of the roller-forming means (M). These gearing means, in their entirety, allow the rotary motion of the drum to be transferred mechanically to the oblique roller, ensuring the anti-curl function on the reel.

It is worth considering that the degree of flexibility of the end plate (13), which remains limited, is not detrimental to the mating of the various bevel pinions, which remain engaged. All of these gearing means can be made of metallic materials or of plastics material.

It is worth noting that the flexible end plate (13), which constitutes the loading arm of the reel, has great simplicity of design and advantageously replaces the systems used according to the prior art.

Based on the roller-shaped means (M), the invention incorporates another arrangement ensuring the return function of the reel. To this end, the means (M) is internally arranged to receive a return spring (22), one end (22*a*) of which takes the form of a loop to fit in a slot (23*a*) formed on the sealing end plate (23), and the other end (22*b*) of which, in the form of a loop, fits on the pulley-forming or pinion-comprising component (17) intended to tension the said spring. This component (17) comprises a cylindrical neck (17*a*) with an end slit, in which the end of the spring engages, and a pulley-forming double collar (17*b*) in the case of a belt-shaped transmission means, or a bevel pinion (21) in the case of a mechanical transmission. The said component fits in a fastening on the roller, followed by a fastening pin (17*c*) on the fixed supporting plate (11). A stop (17*d*) is formed on the inner face of the collar. This stop is capable of cooperating with another stop (25) formed on the shouldered portion (26) established at the end of the roller (R). It will thus be appreciated that the rotation of the said component (17) upon itself torsions the return spring, and the contact of the two stops (25 and 17*d*), with the positioning of the said component (17) in the shouldered portion (26) forming a seat for the means (M), ensures that the whole is locked in position. During operation, the said means (M), by slackening of the spring, can thus cause the reel to rotate in the opposite direction and thus ensures the rewinding of the reel and the prevention of any appearance of curls.

Referring to FIGS. 8 and 9 by way of a variant, the roller-shaped means (M) have a specific arrangement such that the return spring (22) cannot be in contact with the inside of the said roller and cannot create a braking effect detrimental to the sound working of the whole and reducing the desired anti-curl effect.

To this end, the body (30) of the roller (R) receives, at one end, a component (17) of the aforesaid type having a split cylindrical neck (17*a*) located inside the body of the roller following installation, and an appendage (17*c*). On the other side, the body (30) of the roller has, in extension, a shouldered ring (31) of larger section. This ring is obtained in one piece with the said body and serves as a seat for a cylindrical sleeve (32) specifically arranged so as, on the one hand, to receive at one end the return spring (22) and, on the other hand, to receive at its other end a first gearing means (33). More specifically, the sleeve (32) has a main cylindrical neck (32*a*) extending at one end via a second neck (32*b*) of smaller section, split to receive the hook-shaped end (22*a*) of the return spring. The fastening orientation of the spring, through the slit (32*c*), is realized in a plane perpendicular to that formed on the component (17). The spring (22) is therefore slipped onto the second neck (32*b*), fixed in position by the slit (32*c*), such that it cannot move and remains constantly in the longitudinal axial plane of the roller, avoiding all contact with the inner opening of the latter. At the other end, the sleeve (32) has a collar (32*d*) which comes to bear and centres itself in the ring portion. The said collar has a lug (32*e*), which comes into contact and abuts against a pin (32*f*) established in the style of those described (17*d*-25) in FIGS. 4A-4B. The sleeve receives at the end a bevel gearing (33) corresponding to that (21) illustrated in FIG. 7. The specific mounting of the said spring is therefore optimized, preventing any interference with the latter.

As a function of the arrangement of the dispenser and of its specificities, the gear wheel (18), which is linked to the drum (2) of the embodiment illustrated in FIG. 7, can be mounted differently, whilst following the rotary motion of the drum so as to transmit the motion to the said anti-curl roller (R).

In FIG. 10, a construction variant has thus been represented, according to which the gearing (18) is replaced by a gearing (34) of greater length (1) by being directly linked to the control means (35) mounted from the side wall of the housing. This gearing (34) has, nevertheless, a centre axle (34*a*), which is connected with the drum (2). As a result of this specific measure, the gearing (34) offers a greater length of engagement to the gearing (36), which is mounted opposite and belongs to a train of gears (37-38-39-40) emanating from the roller (R), in order to ensure the transmission of the motion in conditions similar to those of FIG. 7. The essential differences lies in the fact that the length of engagement of this gearing (34) allows a slight lateral deflection of the end plate (13) supporting the material reel and the roller (R), as represented in FIG. 6. In other words, if the installation of the material reel is ultimately facilitated by the away movement of one of the two reel-supporting end plates, the length of engagement of the gearing (34) allows any lateral away movement of the end plate in question to be absorbed, whilst maintaining the said engagement of the identified gearings.

Finally, according to another measure of the invention, it is possible, as represented in FIG. 6, to incorporate, on the other side of the reel and starting from the fixed end plate (1), another roller (M), but which, for its part, is mounted in a freely rotatable manner, without any other linkage and transmission means, in oblique position, likewise to constitute a counter-bearing of the material reel.

The advantages will be clearly apparent from the invention. The new design of the anti-curl device is particularly effective for addressing the problem posed by reels of materials of smooth recycled paper.

The invention claimed is:

1. Anti-curl control device for automatic dispenser of wipe materials, the dispenser including a housing with lid, a first fixed end plate rotatably supporting a drum incorporating a cutting device, a material reel wound on a core having an end fitting, and a press roller counter-bearing upon the drum, wherein the anti-curl device comprises roller-shaped means having a peripheral surface with protruding gripping means, the roller-shaped means being freely rotatable relative to supporting plates extending from a reel-holder end plate, the reel-holder end plate receiving the end fitting and being flexible relative to the first fixed end plate, the roller-shaped means being angled obliquely relative to the material reel and coming into localized contact along a generatrix with a last turn of the reel to ensure a braking effect, and said roller-shaped means being linked to rotation of the drum by a transmission means which couples the roller-shaped means and the drum together, and the reel-holder end plate being elasticly deflected in order to adjust in position as the reel is unwound, wherein the first end plate fixedly receives the reel-holder end plate allowing the reel-holder end plate a certain flexibility, and a front portion of the reel-holder end plate is connected to the first end plate with securing means, and wherein the reel-holder end plate extends rearwards from the first end plate and has a tall rear portion for receiving a supporting axle of the end fitting and said supporting plates comprise two parallel supporting plates extending from the rear portion between which is positioned the roller-shaped means.

2. Device according to claim 1, further comprising a return spring anchored at one end, and wherein a lower plate of the supporting plates has a notch for fastening of an other end of the return spring.

3. Device according to claim 1, wherein the transmission means comprises a continuous drive belt, the drum has an end with an extension forming a groove concentric to an axle of the drum and serving to accommodate and guide the belt, and the roller-shaped means has at a bottom end, a component incorporating a pulley-shaped portion for receiving the drive belt in a plane different from position of the belt on the drum.

4. Device according to claim 1, further comprising positioning pins at ends of the roller-shaped means penetrating into the supporting plates.

5. Device according to claim 1, wherein the transmission means comprises pinions.

6. Device according to claim 5, wherein the transmission means comprises a spur gear wheel mounted coaxially at an end of the drum, two coaxial pinions mounted to the first end plate and fixed in a plane perpendicular to the gear wheel, with a first of the coaxial pinions having straight toothing mating with the gear wheel and with a second of the coaxial pinions having conical toothing, and a linking and connecting shaft, mounted to the reel-holder end plate, and having a bevel pinion at each end of the shaft, one bevel pinion cooperating with the second of the coaxial pinions and an other bevel pinion cooperating with a further bevel pinion disposed at an end of the roller-shaped means, whereby rotary motion of the drum is transferred mechanically to the roller-shaped means ensuring anti-curl function on the reel.

7. Device according to claim 1, wherein the roller-shaped means internally receives a return spring, a first end of the spring forms a loop, that fits in a slot formed on a sealing end plate at a first end of the roller-shaped means, and a second end of the spring forms a loop to fit on the component, which component serves to tension the spring, and the component comprises a cylindrical neck with an end-split, in which the second end of the spring engages, and a pulley-forming double collar or a pinion which fits in a fastening at a second end of the roller-shaped means, followed by a fastening pin supported on one of the supporting plates.

8. Device according to claim 7, further including a stop on an inner face of the collar for cooperating with another stop on a shouldered portion at the second end of the roller-shaped means.

9. Device according to claim 1, further comprising on an opposite side of the reel and starting from a second fixed end plate, a second roller-shaped means, the second roller-shaped means being mounted in a freely rotatable manner, without any other linkage and transmission means, in oblique position, to constitute a counter-bearing of the material reel.

10. Device according to claim 1, wherein the roller-shaped means comprises a hollow body receiving, at one end, a component having a split cylindrical neck, with the neck located inside the body following installation, and an external appendage, and, on a second end, the body has, in extension, a shouldered ring of larger section than the body, the ring serving as a seat for a cylindrical sleeve, the sleeve, at one end receiving a return spring, and mounting at an other end, a first gearing means, and wherein the sleeve has a main cylindrical neck extending at one end into a second neck of smaller section, the second neck having a slit to receive a first hook-shaped end of the return spring, a fastening orientation of the spring, through the slit, being realized in a plane perpendicular to a second hook-shaped end of the spring when said second end is connected to the split cylindrical neck of the component.

11. Device according to claim 10, wherein, at the other end, the sleeve has a collar which comes to bear and centers itself in the ring and the collar has a lug, which comes into contact and abuts against a pin.

12. Device according to claim 1, wherein the transmission means comprises a first gearing of greater length directly linked to a control means mounted from a side wall of the housing, the first gearing has a centre axle connected with the drum, and the first gearing offers a greater length of engagement to a second gearing, which is mounted opposite the first gearing and belongs to a train of gears emanating from the roller-shaped means, in order to ensure transmission of motion, and the length of engagement of the first gearing allows a slight lateral deflection of the reel-holder end plate.

* * * * *